US006207262B1

(12) United States Patent
Ichikawa et al.

(10) Patent No.: US 6,207,262 B1
(45) Date of Patent: Mar. 27, 2001

(54) COATED CEMENTED CARBIDE ENDMILL HAVING HARD-MATERIAL-COATED-LAYERS EXCELLENT IN ADHESION

(75) Inventors: Hiroshi Ichikawa; Shogo Inada; Akira Osada; Katsuhiko Sato; Kazuhiro Kawano, all of Yuuki-gun (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 09/145,616

(22) Filed: Sep. 2, 1998

(30) Foreign Application Priority Data

Sep. 2, 1997 (JP) ..... 9-236882

(51) Int. Cl.[7] ..... B32B 19/00

(52) U.S. Cl. ..... 428/216; 51/307; 51/309; 407/119; 427/402; 427/419.1; 427/419.2; 427/419.7; 428/212; 428/325; 428/336; 428/697; 428/698; 428/699; 428/701; 428/702

(58) Field of Search ..... 428/216, 212, 428/336, 325, 697, 698, 699, 701, 702; 51/307, 309; 407/119; 427/402, 418.1, 419.2, 419.7

(56) References Cited

U.S. PATENT DOCUMENTS

| | | | | |
|---|---|---|---|---|
| 4,399,168 | * | 8/1983 | Kullander et al. | 428/698 |
| 4,447,263 | * | 5/1984 | Sugizawa et al. | 428/698 |
| 4,610,931 | * | 9/1986 | Nemeth et al. | 428/547 |
| 4,812,370 | * | 3/1989 | Okada et al. | 428/552 |
| 4,911,989 | * | 3/1990 | Minoru et al. | 428/547 |
| 5,135,801 | * | 8/1992 | Nystrom et al. | 428/699 |
| 5,181,953 | * | 1/1993 | Nakano et al. | 75/243 |
| 5,266,388 | * | 11/1993 | Santhanam et al. | 428/697 |
| 5,364,209 | * | 11/1994 | Santhanam et al. | 407/119 |
| 5,403,652 | * | 4/1995 | Drougge | 428/216 |
| 5,652,045 | * | 7/1997 | Nakamura et al. | 428/212 |

FOREIGN PATENT DOCUMENTS

| | | | |
|---|---|---|---|
| 0 337 696 | * | 10/1989 | (EP) . |
| 61-288914 | | 12/1986 | (JP) . |
| 62-088509 | | 4/1987 | (JP) . |

* cited by examiner

*Primary Examiner*—Archene Turner
(74) *Attorney, Agent, or Firm*—Oblon, Spivak, McClelland, Maier & Neustadt, P.C.

(57) ABSTRACT

A coated cemented carbide endmill comprises a tungsten carbide based cemented carbide substrate comprising 5–20% Co as a binder phase forming component, optionally 0.1–2% of Cr and/or V as a binder phase forming component, optionally 0.1–5% of one or more of (Ti, Ta, Nb, Zr) C·N as a dispersed phase forming component, and the balance being WC as the dispersed phase forming component and inevitable impurities. The WC has a fine grained structure having an average grain size of 0.1–1.5 $\mu$m, the cemented carbide substrate has a reaction-created surface layer formed on the surface portion thereof which is formed by heating at high temperature and in which $Co_mW_nC$ is distributed over a thickness of 0.1–2 $\mu$m thereof, and further the substrate has coated layers composed of a Ti compound layer. Optionally, an $Al_2O_3$ layer is formed thereon with an average layer thickness of 0.5–4.5 $\mu$m, the Ti compound layer being composed of one or more layers of TiC, TiN, TiCN, TiCO, TiNO and TiCNO using MT-CVD and the $Al_2O_3$ layer is formed using MT-CVD or HT-CVD. The hard-material-coated layers of the endmill have excellent adhesion.

33 Claims, No Drawings

COATED CEMENTED CARBIDE ENDMILL HAVING HARD-MATERIAL-COATED-LAYERS EXCELLENT IN ADHESION

BACKGROUND OF THE INVENTION

1. Field of the Invention

The present invention relates to a coated cemented carbide endmill exhibiting excellent wear resistance for a long period of time.

2. Description of the Background

Conventionally, coated cemented carbide endmills are composed of a tungsten carbide (WC) based cemented carbide substrate (hereinafter "cemented carbide substrate") having a surface portion with an average layer thickness of 0.5–5 $\mu$m of hard-material-coated-layers composed of a Ti compound. The Ti compound is one or more layers of a titanium carbide (TiC), titanium nitride (TiN), titanium carbide-nitride (TiCN), titanium oxy-carbide (TiCO), titanium oxy-nitride (TiNO) and titanium oxy-carbo-nitride (TiCNO). Each of the hard-material-coated-layers is formed by medium temperature chemical vapor deposition (MT-CVD) (a method in which vapor deposition is performed at 700–980° C., a temperature lower than the vapor deposition temperature 1000–1150° C. employed by ordinary high temperature chemical vapor deposition (HT-CVD)), as shown in, for example, in Japanese Unexamined Patent Publication No. 62-88509.

In order to save labor and energy, there has been a tendency to increase cutting speed in a cutting process. When the conventional coated cemented carbide endmills are used under these high speed conditions, the hard-material-coated layers tend to exfoliate due to insufficient adhesion, resulting in endmills which are remarkably worn and which have a relatively short life.

SUMMARY OF THE INVENTION

An object of the invention is to provide a coated cemented carbide endmill having hard-material-coated layers having excellent adhesion.

The inventors of the present invention directed their attention to the conventional coated cemented carbide endmills and made studies to improve the adhesion of the hard-material-coated layers. As a result, the inventors discovered that when a coated cemented carbide endmill is arranged as shown in the following items (a), (b) and (c), the adhesion of the Ti compound layer to the surface of the cemented carbide substrate of the endmill is greatly improved by a surface layer formed on the surface portion thereof by heating at high temperatures. The hard-material-coated layer of the coated cemented carbide endmill is not exfoliated even if the endmill is used in high speed cutting, and furthermore the endmill exhibits excellent wear resistance over a long period of time:

(a) the cemented carbide substrate has a composition of 5–20 wt % of Co (hereinafter, % means wt %) as a binder phase forming component, optionally 0.1–2% of Cr and/or V as binder phase forming components, optionally, 0.1–5% of one or more carbides, nitrides and carbonitrides of Ti, Ta, Nb and/or Zr, such as TiC, TiN, TiCN, TaC, TaN, TaCN, NbC, NbN, NbCN, ZrC, ZrN and ZRCN, as well as two or more solid solutions thereof (hereinafter "(Ti, Ta, Nb, Zr) C·N") as a dispersed phase forming component, and the balance WC as a dispersed phase forming component and inevitable impurities, wherein the WC has a fine grained structure having an average grain size of 0.1–1. 5 $\mu$m;

(b) when the cemented carbide substrate shown in (a) is heated at a high temperature in a hydrogen atmosphere containing a carbon dioxide gas or titanium tetrachloride at a pressure of 50–550 torr, and the substrate is held at a temperature of 900–1000° C. for 1–15 minutes, a reaction-created surface layer, in which a complex carbide of Co and W ($Co_mW_nC$ or cobalt tungsten carbide) is distributed, is formed on the surface portion of the base substance over a predetermined thickness;

(c) hard-material-coated layers composed of a Ti compound layer and, optionally, an aluminum oxide ($Al_2O_3$) layer, are formed on the surface of the substrate having the reaction-created surface layer which is formed by heating at high temperature and in which $Co_mW_nC$ shown in (b) is distributed, wherein the Ti compound layer is composed of one or more layers of TiC, TiN, TiCN, TiCO, TiNO and TiCNO, using MT-CVD, and the optional aluminum oxide layer is formed using MT-CVD or HT-CVD.

DETAILED DESCRIPTION OF THE INVENTION

The present invention includes a coated cemented carbide endmill having hard-material-coated layers excellent in adhesion, the endmill comprising a tungsten carbide based cemented carbide substrate comprising 5–20% Co as a binder phase forming component, optionally 0.1–2% of Cr and/or V as a binder phase forming component, optionally 0.1–5% of one or more of (Ti, Ta, Nb, Zr) C·N as a dispersed phase forming component, and the balance being WC as the dispersed phase forming component and inevitable impurities. The WC has a fine grained structure having an average grain size of 0.1–1.5 $\mu$m, the cemented carbide substrate has a reaction-created surface layer formed on the surface portion thereof which is formed by heating at high temperature and in which $Co_mW_nC$ is distributed over a thickness of 0.1–2 $\mu$m thereof, and further the substrate has coated layers composed of a Ti compound layer. Optionally, an $Al_2O_3$ layer is formed thereon with an average layer thickness of 0.5–4.5 $\mu$m, the Ti compound layer being composed of one or more layers of TiC, TiN, TiCN, TiCO, TiNO and TiCNO using MT-CVD and the $Al_2O_3$ layer is formed using MT-CVD or HT-CVD.

Next, reasons why the compositions of the cemented carbide substrate constituting the coated cemented carbide endmill of the present invention, the average particle size of WC particles and the average thickness of the reaction-created surface layer and the average layer thickness of the hard-material coated layers, are limited as described above, will be described.

Co Content

Co improves sinterability, thereby improving the toughness of the cemented carbide substrate. When the Co content is less than 5%, however, the desired toughness improving effect is not obtained, whereas when the Co content is larger than 20%, not only is the wear resistance of the cemented carbide substrate itself lowered, but also the cemented carbide substrate is deformed by the heat generated during high speed cutting. Thus, the Co content is 5–20%, preferably to 8–12%.

Cr and V Content

Cr and V dissolve in solid Co as the binder phase forming component, strengthening it as well as contributing to inhibit the growth of WC grains. Furthermore, Cr and V act to promote the formation of the reaction-created surface layer in which $Co_mW_nC$ is distributed, formed by heating at high temperature thereby improving the adhesion of the hard-material-coated layers achieved by the reaction-created surface layer. When the content of Cr and/or V is less than 0.1%, however, it cannot be expected that the above effect is achieved, whereas when the content of Cr and/or V is larger than 2%, the above action is saturated and the improving effect is not further enhanced. Thus, the content of Cr and/or V is set to 0.1–2%, preferably 0.4–0.8%.

When the coated cemented carbide endmill is made, it is preferable that Cr and V as the binder phase forming component are used in the form of carbides, nitrides and oxides of Cr and/or V (such as $Cr_3C_2$, CrN, $Cr_2O_3$, VC, VN and $V_2O_5$) (hereinafter "(Cr, V) C·N·O as the entire group") as material powders. Since these material powders are dissolved in solid Co as the binder phase forming component when sintering is carried out, and form a binder phase, a precipitate containing Cr and/or V as an individual component cannot be observed by optical microscopy or scanning electron microscopy.

(Ti, Ta, Nb, Zr) C·N Content

These components act to improve the wear resistance of the cemented carbide substrate. When their content is less than 0.1%, however, the desired wear resistance improving effect is not obtained. When they are present in an amount larger than 5%, toughness is lowered. Thus, the individual content of each is set to 0.1–5%, preferably 1–2.5%.

Average Particle Size of WC

The strength of the cemented carbide substrate is improved by the fine grained structure of WC grains. The fine grained structure is obtained by choosing the particle size of WC powder used as material powder to be 1.5 μm or less. Accordingly, when the average particle size of the material powder is larger than 1.5 μm, the desired strength improving effect is not obtained, whereas when it is less than 0.1 μm, wear resistance is lowered. Thus, the average particle size of the WC powder is selected to be 0.1–1.5 μm, preferably 0.6–1.0 μm, and the average grain size of WC grains in the cemented carbide substrate is 0.1–1.5 μm, preferably 0.6–1.0 μm.

Average Thickness of Reaction-Created Surface Layer

The portion of the endmill which contributes to cutting is the cutting edge, and the portion of the endmill which is far from the cutting edge does not contribute to cutting, and therefore the average thickness of the reaction-created surface layer, in which $Co_mW_nC$ is distributed, is important at the cutting edge. When the average thickness of the reaction-created surface layer is less than 0.1 μm, the ratio of its distribution in the surface layer formed by heating at high temperature is too small for the reaction-created surface layer to secure the desired adhesion to the hard-material-coated layers. When the average thickness of the reaction-created surface layer is larger than 2 μm, the ratio of the average thickness of the reaction-created surface layer is excessively large, and therefore chipping is liable to occur at the cutting edge. Thus, the average thickness is chosen to be 0.1–2 μm, preferably 0.5–1.5 μm.

Average Layer Thickness of the Hard-Material-Coated Layers

When the average layer thickness of the hard-material-coated layers is less than 0.5 μm, the desired excellent wear resistance is not be obtained, whereas when the average layer thickness is larger than 4.5 μm, chipping is liable to occur at the cutting edge. Thus, the average layer thickness is set selected to 0.5–4.5 μm, preferably to 1.5–2.5 μm.

EXAMPLES

Having generally described this invention, a further understanding can be obtained by reference to certain specific examples which are provided herein for purposes of illustration only and are not intended to be limiting unless otherwise specified.

Embodiment 1

WC powder having an average particle size within the range of 0.1–1.5 μm, various carbide powder, nitride powder and carbo-nitride powder each having the average particle size of 0.5 μm as shown in Table 1 and Table 2 and constituting (Ti, Ta, Nb, Zr) C·N and Co powder having an average particle size of 0.5 μm, were prepared as material powders. These material powders were blended to the composition shown in Table 1 and Table 2, wet mixed in a ball mill for 72 hours and dried, and thereafter pressed to form green compact at a pressure of 1 ton/cm$^2$. The green compacts were vacuum sintered for one hour in a vacuum of $1\times10^{-3}$ torr at a temperature within the range of 1350–1500° C. The cemented carbide substrates a–z which had compositions substantially similar to the above blended compositions and contained WC grains having the average grain sizes shown in Table 1 and Table 2 were formed.

Cemented carbide substrates A–Z were made by forming a surface layer by heating at high temperature the surface portion of each of the cemented carbide substrates a–z under the conditions shown in Table 3 and Table 4, the reaction-created surface layer having distributed $Co_mW_nC$ over the average thickness shown in Table 3 and Table 4.

Subsequently, hard-material-coated layers having the compositions and the average layer thicknesses shown in Table 6 and Table 7 were formed under the conditions shown in Table 5 on the surface of each of the cemented carbide substrates A–Z and coated cemented carbide ball-nose endmills of the present invention (hereinafter "coated endmills of the present invention") 1–26 were made. The endmills were composed of a shank portion and a two-flute portion and had a ball-nose radius of 5 mm and a nelix angle of 30°.

For the purpose of comparison, comparative coated cemented carbide endmills (hereinafter "comparative coated endmill") 1–26 were made, respectively under conditions similar to the above conditions except that cemented carbide substrates a–z, to which the surface layer formed by heating at high temperature was not formed, were used in place of the cemented carbide substrates A–Z having the above surface layer as shown in Table 8.

Next, high speed copy milling was carried out, using the coated endmills 1–26 of the present invention and the comparative coated endmills 1–26, on alloy steel in a dry state by alternate down-cut and up-cut milling under the following conditions. The worn width of the maximum flank face of the cutting edge of each of the endmills was measured.

material to be cut: SKD61 (hardness: HRC: 53)

cutting speed: 800 m/min feed per tooth: 0.1 mm/cutting edge depth of cut: 0.5 mm width of cut: 0.5 mm length of cut: 250 m Since the comparative coated endmills 1–26 were worn at high speed, the cutting operation was interrupted when the width of the maximum flank wear of the cutting edge reached 0.3 mm, and the cut length up to that time was measured. Tables 6–8 show the resulting measurements.

Embodiment 2

WC powder having an average particle size within the range of 0.1–1.5 μm, $Cr_3C_2$ powder having an average particle size of 0.5 μm, VC powder having an average particle size of 0.5 μm and Co powder having an average particle size of 0.5 μm were prepared as material powders. These material powders were blended at a predetermined blend ratio, wet mixed in a ball mill for 72 hours and dried, and thereafter pressed to green compact at the pressure of 1 ton/cm$^2$ and the green compact was vacuum sintered for one hour in a vacuum of $1\times10^{-3}$ torr at a temperature within the range of 1350–1500° C. The cemented carbide substrates a–t which had the compositions shown in Table 9 and contained WC grains having the average grain size shown in Table 9 were formed.

Cemented carbide substrates A–T were made by forming a surface layer by heating at high temperature the surface portion of each of the cemented carbide substrates a–z under the conditions shown in Table 10, the reaction-created surface layer having distributed $Co_mW_nC$ over the average thickness shown in Table 10.

Subsequently, hard-material-coated layers having the compositions and the average layer thicknesses shown in Table 12 were formed under the conditions shown in Table 11 on the surface of each of the cemented carbide substrates A–T and coated cemented carbide ball-nose endmills of the present invention (hereinafter "coated endmills of the present invention") 1–20 were made. The endmills were composed of a shank portion and a two-flute portion and had a ball-nose radius of 5 mm and a helix angle of 30°.

For the purpose of comparison, comparative coated cemented carbide endmills (hereinafter "comparative coated endmills") 1–20 were made, respectively under conditions similar to the above conditions except that cemented carbide substrates a–t, to which the surface layer formed by heating at high temperature was not formed, were used in place of the cemented carbide substrates A–T having the above surface layer as shown in Table 13.

Next, high speed copy milling was carried out, using the coated endmills 1–20 of the present invention and the comparative coated endmills 1–20, on alloy steel in a dry state by alternate down-cut and up-cut milling under the following conditions. The worn width of the maximum flank face of the cutting edge of each of the endmills was measured.

material to be cut: SKD61 (hardness: HRC: 53)

cutting speed: 500 m/min feed per tooth: 0.1 mm/cutting edge depth of cut: 0.5 mm width of cut: 0.5 mm length of cut: 350 m Table 12 and Table 13 show the result of measurement, respectively.

Embodiment 3

WC powder having an average particle size within the range of 0.1–1.5 μm, various carbide powder, nitride powder, oxide powder and carbo-nitride powder each having an average particle size of 0.5 μm and constituting (Ti, Ta, Nb, Zr) C·N and (Cr, V) C·N·O, Co powder having an average particle size of 0.5 μm and carbon powder for adjusting an amount of carbon, were prepared as material powders. These material powders were blended to a predetermined composition, wet mixed in a ball mill for 72 hours and dried, and thereafter pressed to green compact at the pressure of 1 ton/cm$^2$ and the green compact was vacuum sintered for one hour in a vacuum of $1\times10^{-3}$ torr at a temperature in the range of 1350–1500° C. Cemented carbide substrates a–s which had the compositions shown in Table 14 and contained WC grains having the average grain size shown in Table 14 were formed.

Cemented carbide substrates A–S were made by forming a surface layer by heating at high temperature the surface portion of each of the cemented carbide substrates a–s under the conditions shown in Table 15, the reaction-created surface layer having distributed $Co_mW_nC$ over the average thickness shown in Table 15.

Subsequently, hard-material-coated layers having the compositions and the average layer thicknesses shown in Table 17 were formed under the conditions shown in Table 16 on the surface of each of the cemented carbide substrates A–S and coated carbide ball-nose endmills of the present invention (hereinafter, "coated endmills of the present invention") 1–19 were made. The endmills were composed of a shank portion and a two-flute portion and had a ball-nose radius of 5 mm and a helix angle of 30°.

For the purpose of comparison, comparative coated cemented carbide endmills (hereinafter "comparative coated endmills") 1–19 were made, respectively under conditions similar to the above conditions except that cemented carbide substrates a–s, to which the surface layer formed by heating at high temperature was not formed, were used in place of the cemented carbide substrates A–S having the above surface layer as shown in Table 18.

Next, high speed copy milling was carried out, using the coated endmills 1–19 of the present invention and the comparative coated endmills 1–19, on alloy steel in a dry state by alternate down-cut and up-cut milling, under the following conditions. The width of the maximum flank wear of the cutting edge of each of the endmills was measured.

material to be cut: SKD61 (hardness: HRC: 53)

cutting speed: 650 m/min feed-per tooth: 0.1 mm/cutting edge depth of cut: 0.5 mm width of cut: 0.5 mm time of cut: 50 min Table 17 and Table 18 show the result of measurement, respectively.

It is apparent from the results shown in Tables 6–8, 12, 13, 17 and 18 that the hard-material-coated layers of the coated endmills of the present invention were not exfoliated and the endmills thereby exhibited excellent wear resistance. In contrast, the hard-material coated layers of the comparative coated endmills were exfoliated midway through the cutting process and the endmills were greatly worn by the exfoliation and their life was ended in a relatively short period of time.

In the coated carbide endmills of the present invention, since the adhesion of the hard-material-coated layers to the surface of the cemented carbide substrate is greatly improved by the reaction-created surface layer, in which Co,WWnC is distributed, formed on the surface portion of the base substance by heating at high temperature as described above, the hard-material-coated layers are not exfoliated, not only when the endmills are used under usual cutting conditions but also even if the endmills are used in high speed cutting. Accordingly, the coated cemented carbide endmills of the present invention exhibit excellent wear resistance for a long period of time.

TABLE 1

| Type | | Composition (wt %) | Average grain size of WC (μm) |
|---|---|---|---|
| Cemented carbide substrate | a | Co: 5, WC + impurities: balance | 1.2 |
| | b | Co: 8, WC + impurities: balance | 0.8 |
| | c | Co: 10, WC + impurities: balance | 1.0 |
| | d | Co: 12, WC + impurities: balance | 1.2 |
| | e | Co: 15, WC + impurities: balance | 0.6 |
| | f | Co: 20, WC + impurities: balance | 0.4 |
| | g | Co: 13, TiN: 2.5, WC + impurities: balance | 0.4 |
| | h | Co: 10, TaC: 2, WC + impurities: balance | 0.8 |
| | i | Co: 6, NbC: 0.5, WC + impurities: balance | 1.2 |
| | j | Co: 5, ZrCN: 0.1, WC + impurities: balance | 1.5 |
| | k | Co: 7, (Ti, Ta) N: 0.8, WC + impurities: balance | 1.0 |
| | l | Co: 15, (Ti, Nb) CN: 3.5, NbCN: 0.5, WC + impurities: balance | 0.5 |
| | m | Co: 8, (Ti, Zr) CN: 1, WC + impurities: balance | 0.6 |
| | n | Co: 8, (Ta, Nb) C: 1.5, WC + impurities: balance | 1.0 |

TABLE 2

| Type | | Composition (wt %) | Average grain size of WC (μm) |
|---|---|---|---|
| Cemented carbide substrate | o | Co: 12, (Ta, Zr) C: 2, WC + impurities: balance | 0.6 |
| | p | Co: 6, (Zr, Nb) N: 1.2, NbN: 0.3, WC + impurities: balance | 1.2 |
| | q | Co: 10, (Ti, Ta, Nb) C: 2.2, WC + impurities: balance | 0.8 |
| | r | Co: 20, (Ti, Ta. Zr) N: 5, WC + impurities: balance | 0.1 |
| | s | Co: 12, (Ti, Zr, Nb) CN: 2.5, WC + impurities: balance | 0.6 |
| | t | Co: 8, (Ta, Nb, Zr) C: 1, TiCN: 0.5, WC + impurities: balance | 1.2 |
| | u | Co: 6, (Ti, Ta, Zr, Nb) C: 1, WC + impurities: balance | 0.8 |
| | v | Co: 10, TaN: 1.5, TiC: 0.5, WC + impurities: balance | 1.2 |
| | w | Co: 7, (Ti, Zr) C: 0.4, ZrN: 0.1, WC + impurities: balance | 0.8 |
| | x | Co: 17, (Ti, Zr) N: 1, (Ti, Ta, Zr) C: 3, TaCN: 0.6, WC + impurities: balance | 1.5 |
| | y | Co: 12, TiC: 0.2, ZrC: 0.8, (Ta, Nb) C: 1, WC + impurities: balance | 1.0 |
| | z | Co: 15, TiN: 0.5, TaC: 1, ZrCN: 1, NbC: 0.5, WC + impurities: balance | 0.4 |

TABLE 3

| | | | Surface layer formed by being heated at high temperature | | | | |
|---|---|---|---|---|---|---|---|
| | | | Forming conditions | | | | |
| | | | Atmosphere | | | | |
| Type | | Symbol of substrate | Ratio of composition blended to $H_2$ (vol %) | Pressure (torr) | Temperature (° C.) | Holding time (min.) | Average thickness of reaction-created surface layer (μm) |
| Cemented carbide substrate | A | a | $CO_2$: 11 | 250 | 950 | 6 | 1.64 |
| | B | b | $TiCl_4$: 2 | 550 | 900 | 11 | 0.83 |
| | C | c | $CO_2$: 10 | 300 | 950 | 10 | 1.27 |
| | D | d | $TiCl_4$: 3 | 400 | 920 | 7 | 0.80 |
| | E | e | $CO_2$: 10 | 50 | 900 | 5 | 0.24 |
| | F | f | $TiCl_4$: 2 | 150 | 900 | 5 | 0.41 |
| | G | g | $TiCl_4$: 2 | 450 | 900 | 10 | 1.73 |
| | H | h | $CO_2$: 11 | 350 | 950 | 12 | 1.48 |
| | I | i | $CO_2$: 9 | 550 | 1000 | 15 | 2.00 |
| | J | j | $TiCl_4$: 1 | 300 | 950 | 10 | 0.99 |
| | K | k | $TiCl_4$: 3 | 50 | 1000 | 5 | 0.45 |
| | L | l | $CO_2$: 11 | 200 | 950 | 5 | 1.28 |
| | M | m | $CO_2$: 9 | 80 | 900 | 6 | 0.31 |

TABLE 4

| | | | Surface layer formed by being heated at high temperature | | | | |
|---|---|---|---|---|---|---|---|
| | | | Forming conditions | | | | |
| | | | Atmosphere | | | | |
| Type | | Symbol of substrate | Ratio of composition blended to $H_2$ (vol %) | Pressure (torr) | Temperature (° C.) | Holding time (min.) | Average thickness of reaction-created surface layer (μm) |
| Cemented carbide substrate | N | n | $TiCl_4$: 1 | 250 | 900 | 13 | 1.02 |
| | O | o | $TiCl_4$: 3 | 450 | 950 | 11 | 0.56 |
| | P | p | $CO_2$: 9 | 300 | 1000 | 13 | 1.52 |
| | Q | q | $CO_2$: 10 | 500 | 950 | 15 | 1.80 |
| | R | r | $TiCl_4$: 1 | 100 | 900 | 6 | 0.53 |
| | S | s | $TiCl_4$: 3 | 450 | 1000 | 14 | 1.45 |
| | T | t | $CO_2$: 11 | 500 | 1000 | 15 | 1.82 |
| | U | u | $TiCl_4$: 1 | 500 | 900 | 5 | 0.11 |
| | V | v | $TICl_4$: 3 | 100 | 900 | 7 | 0.36 |
| | W | w | $CO_2$: 9 | 300 | 950 | 9 | 1.01 |
| | X | x | $TiCl_4$: 2 | 450 | 900 | 10 | 1.98 |
| | Y | y | $CO_2$: 11 | 100 | 900 | 6 | 0.33 |
| | Z | z | $TiCl_4$: 2 | 400 | 950 | 8 | 1.81 |

TABLE 5

| | Hard-material-coated-layer forming conditions | | |
|---|---|---|---|
| | | Reaction atmosphere | |
| Type of hard-material-coated-layer | Composition of reaction gas (vol %) | Pressure (torr) | Temperature (° C.) |
| $Al_2O_3$ · | $Al_2Cl_3$: 4, $CO_2$: 10, $H_2S$: 0.2, HCl: 2, $H_2$: balance | 50 | 1020 |
| $Al_2O_3$ | $Al[OCH(CH_3)_2]_3$: 0.3, $H_2$: balance | 50 | 900 |
| TiC | $TiCl_4$: 2, $C_3H_8$: 5, $H_2$: balance | 100 | 900 |
| TiN | $TiCl_4$: 2, N: 30, H : balance | 100 | 850 |

TABLE 5-continued

| Type of hard-material-coated-layer | Hard-material-coated-layer forming conditions: Composition of reaction gas (vol %) | Reaction atmosphere: Pressure (torr) | Reaction atmosphere: Temperature (° C.) |
|---|---|---|---|
| TiCN | $TiCl_4$: 2, $N_2$: 10, $CH_3CN$: 0.8, $H_2$: balance | 70 | 900 |
| TiCO | $TiCl_4$: 3, CO: 2, $H_2$: balance | 100 | 900 |
| TiNO | $TiCl_4$: 3, CO: 1, $N_2$: 15, $H_2$: balance | 50 | 900 |
| TiCNO | $TiCl_4$: 3, CO: 2, $N_2$: 15, $H_2$: balance | 50 | 900 |

[In Table 5, item with * shows high, temperature chemical vapor deposition (HT-CVD) and items without * show medium temperature chemical vapor deposition (MT-CVD).]

TABLE 6

| Type | Symbol of substrate | Hard-material-coated-layer (average layer thickness is shown in parentheses, unit: μm): First layer | Second layer | Third layer | Fourth layer | Fifth layer | Width of max-flank wear of cutting edge |
|---|---|---|---|---|---|---|---|
| Coated carbide endmill of the present invention | | | | | | | |
| 1 | A | TiCN(0.9) | TiCNO(0.1) | $Al_2O_2$(0.5)* | TiCO(0.1) | TiN(0.3) | 0.13 |
| 2 | B | TiC(0.5) | TiCO(0.3) | $Al_2O_2$(0.2) | — | — | 0.09 |
| 3 | C | TiN(0.1) | TiCN(1.8) | TiCNO(0.1) | $Al_2O_3$(0.5)* | TiN(0.2) | 0.06 |
| 4 | D | TiC(1.9) | TiCNO(0.5) | TiN(0.1) | — | — | 0.10 |
| 5 | E | TiN(0.8) | TiCN(0.2) | — | — | — | 0.19 |
| 6 | F | TiCN(2.0) | — | — | — | — | 0.18 |
| 7 | G | TiCN(0.3) | TiCNO(0.1) | $Al_2O_2$(0.1) | — | — | 0.15 |
| 8 | H | TiCN(1.6) | $Al_2O_3$(0.4)* | — | — | — | 0.05 |
| 9 | I | TiN(0.1) | TiC(0.5) | TiCN(0.9) | — | — | 0.18 |
| 10 | J | TiC(1.0) | TiCN(0.9) | TiCNO(0.1) | $Al_2O_3$(1.0) | — | 0.13 |
| 11 | K | TiC(0.1) | TiCN(4.4) | — | — | — | 0.18 |
| 12 | L | TiN(0.5) | TiC(2.5) | $Al_2O_2$(0.5)* | — | — | 0.12 |
| 13 | M | TiCN(1.3) | TiNO(0.1) | $Al_2O_3$(0.4)* | TiN(0.2) | — | 0.10 |

[In Table 6, item with * shows hard-material-coated-layer made by high temperature chemical vapor deposition and items without * show hard-material-coated-layers made by medium temperature chemical vapor deposition, respectively.]

TABLE 7

| Type | Symbol of substrate | Hard-material-coated-layer (average layer thickness is shown in parentheses, unit: μm): First layer | Second layer | Third layer | Fourth layer | Fifth layer | Width of max-flank wear of cutting edge |
|---|---|---|---|---|---|---|---|
| Coated carbide endmill of the present invention | | | | | | | |
| 14 | N | TiN(0.1) | TiCN(1.2) | TiCNO(0.1) | $Al_2O_3$(0.2)* | — | 0.07 |
| 15 | O | TiC(0.5) | TiCNO(0.1) | $Al_2O_3$(0.1) | — | — | 0.09 |
| 16 | P | TiN(0.1) | TiC(2.0) | TiCN(2.0) | TiNO(0.1) | TiN(0.3) | 0.17 |
| 17 | Q | TiN(0.1) | TiCN(1.4) | TiN(0.1) | — | — | 0.17 |
| 18 | R | TiN(0.1) | TiCN(1.0) | TiC(1.0) | TiCNO(0.5) | $Al_2O_3$(0.2)* | 0.13 |
| 19 | S | TiN(0.2) | TiCN(3.0) | TiCNO(0.1) | $Al_2O_3$(0.2) | — | 0.09 |
| 20 | T | TiN(0.5) | TiC(1.0) | TiCN(1.5) | TiN(0.5) | — | 0.19 |
| 21 | U | TiN(0.1) | TiCN(1.0) | TiCNO(0.1) | $Al_2O_3$(0.1) | — | 0.14 |
| 22 | V | TiCN(4.0) | TiN(0.5) | — | — | — | 0.18 |
| 23 | W | TIN(0.1) | TiCN(2.1) | $Al_2O_3$(0.3)* | — | — | 0.09 |

TABLE 7-continued

| Type | Symbol of substrate | Hard-material-coated-layer (average layer thickness is shown in parentheses, unit: μm) First layer | Second layer | Third layer | Fourth layer | Fifth layer | Width of max-flank wear of cutting edge |
|---|---|---|---|---|---|---|---|
| 24 | X | TiN(0.5) | — | — | — | — | 0.20 |
| 25 | Y | TiCN(0.3) | TiCNO(1.4) | $Al_2O_3$(0.1)* | — | — | 0.10 |
| 26 | Z | TiCN(3.0) | $Al_2O_3$(0.5) | — | — | — | 0.12 |

[In Table 7, item with * shows hard-material-coated-layer made by high temperature chemical vapor deposition and items without * show hard-material-coated-layers made by medium temperature chemical vapor deposition, respectively.]

TABLE 8

| Type | Symbol of substrate | Hard-material-coated-layer | Result of cutting test |
|---|---|---|---|
| Comparative coated carbide endmill | | | |
| 1 | a | similar to coated carbide endmill 1 of the present invention | life ended in 175 m |
| 2 | b | similar to coated carbide endmill 2 of the present invention | life ended in 150 m |
| 3 | c | similar to coated carbide endmill 3 of the present invention | life ended in 200 m |
| 4 | d | similar to coated carbide endmill 4 of the present invention | life ended in 125 m |
| 5 | e | similar to coated carbide endmill 5 of the present invention | life ended in 125 m |
| 6 | f | similar to coated carbide endmill 6 of the present invention | life ended in 150 m |
| 7 | g | similar to coated carbide endmill 7 of the present invention | life ended in 150 m |
| 8 | h | similar to coated carbide endmill 8 of the present invention | life ended in 200 m |
| 9 | i | similar to coated carbide endmill 9 of the present invention | life ended in 125 m |
| 10 | j | similar to coated carbide endmill 10 of the present invention | life ended in 150 m |
| 11 | k | similar to coated carbide endmill 11 of the present invention | life ended in 100 m |
| 12 | l | similar to coated carbide endmill 12 of the present invention | life ended in 150 m |
| 13 | m | similar to coated carbide endmill 13 of the present invention | life ended in 200 m |
| 14 | n | similar to coated carbide endmill 14 of the present invention | life ended in 175 m |
| 15 | o | similar to coated carbide endmill 15 of the present invention | life ended in 150 m |
| 16 | p | similar to coated carbide endmill 16 of the present invention | life ended in 100 m |
| 17 | q | similar to coated carbide endmill 17 of the present invention | life ended in 125 m |
| 18 | r | similar to coated carbide endmill 18 of the present invention | life ended in 150 m |

TABLE 8-continued

| Type | Symbol of substrate | Hard-material-coated-layer | Result of cutting test |
|---|---|---|---|
| 19 | s | similar to coated carbide endmill 19 of the present invention | life ended in 150 m |
| 20 | t | similar to coated carbide endmill 20 of the present invention | life ended in 125 m |
| 21 | u | similar to coated carbide endmill 21 of the present invention | life ended in 150 m |
| 22 | v | similar to coated carbide endmill 22 of the present invention | life ended in 100 m |
| 23 | w | similar to coated carbide endmill 23 of the present invention | life ended in 175 m |
| 24 | x | similar to coated carbide endmill 24 of the present invention | life ended in 150 m |
| 25 | y | similar to coated carbide endmill 25 of the present invention | life ended in 200 m |
| 26 | z | similar to coated carbide endmill 26 of the present invention | life ended in 150 m |

TABLE 9

| Type | | Composition ( wt %) Co | Cr | V | WC + impurities | Average grain size of WC (μm) |
|---|---|---|---|---|---|---|
| Cemented carbide substrate | a | 8.1 | 0.52 | 0.10 | balance | 0.52 |
| | b | 9.8 | 0.40 | 0.21 | balance | 0.76 |
| | c | 7.8 | 0.28 | 0.12 | balance | 0.95 |
| | d | 10.3 | 0.11 | 0.30 | balance | 0.83 |
| | e | 12.4 | 0.23 | 0.45 | balance | 0.51 |
| | f | 11.6 | 0.78 | 0.22 | balance | 0.80 |
| | g | 19.7 | 1.71 | 0.31 | balance | 0.11 |
| | h | 15.1 | 0.13 | 0.08 | balance | 1.23 |
| | i | 18.2 | — | 1.52 | balance | 0.30 |
| | j | 7.9 | — | 0.61 | balance | 1.17 |
| | k | 5.0 | — | 0.11 | balance | 1.50 |
| | l | 9.6 | — | 0.48 | balance | 0.82 |
| | m | 6.3 | — | 0.29 | balance | 0.12 |
| | n | 19.8 | — | 0.13 | balance | 1.54 |
| | o | 10.1 | 0.82 | — | balance | 1.04 |
| | p | 8.0 | 0.55 | — | balance | 0.51 |
| | q | 6.1 | 0.32 | — | balance | 1.47 |
| | r | 17.8 | 1.54 | — | balance | 0.33 |
| | s | 15.2 | 0.96 | — | balance | 0.80 |
| | t | 12.0 | 1.03 | — | balance | 0.49 |

TABLE 10

| Type | Symbol of substrate | Surface layer formed by being heated at high temperature — Forming conditions — Atmosphere — Ratio of composition blended to $H_2$ (vol %) | Pressure (torr) | Temperature (° C.) | Holding time (min.) | Average thickness of reaction-created surface layer (μm) |
|---|---|---|---|---|---|---|
| Cemented carbide substrate | | | | | | |
| A | a | $CO_2$: 11 | 250 | 1000 | 5 | 0.96 |
| B | b | $TiCl_4$: 2 | 450 | 950 | 1 | 0.52 |
| C | c | $CO_2$: 9 | 350 | 1000 | 10 | 1.52 |
| D | d | $TiCl_4$: 2 | 550 | 900 | 7 | 1.04 |
| E | e | $TiCl_4$: 3 | 500 | 1000 | 7 | 1.50 |
| F | f | $TiCl_4$: 1 | 300 | 900 | 7 | 0.48 |
| G | g | $TiCl_4$: 2 | 50 | 900 | 1 | 0.12 |
| H | h | $CO_2$: 9 | 200 | 950 | 3 | 0.31 |
| I | i | $TiCl_4$: 1 | 400 | 950 | 7 | 1.06 |
| J | j | $TiCl_4$: 2 | 450 | 950 | 7 | 1.33 |
| K | k | $CO_2$: 10 | 550 | 1000 | 10 | 1.95 |
| L | l | $CO_2$: 9 | 250 | 950 | 5 | 0.51 |
| M | m | $TiCl_4$: 3 | 550 | 1000 | 7 | 1.80 |
| N | n | $CO_2$: 9 | 500 | 1000 | 10 | 1.76 |
| O | o | $TiCl_4$: 2 | 400 | 950 | 5 | 0.97 |
| P | p | $TiCl_4$: 2 | 500 | 950 | 10 | 1.46 |
| Q | q | $TiCl_4$: 3 | 200 | 900 | 3 | 0.30 |
| R | r | $TiCl_4$: 1 | 550 | 950 | 10 | 1.89 |
| S | s | $CO_2$: 10 | 100 | 900 | 1 | 0.28 |
| T | t | $CO_2$: 11 | 200 | 950 | 3 | 0.47 |

TABLE 11

| Type of hard-material-coated-layer | Hard-material-coated-layer forming conditions — Composition of reaction gas (vol %) | Reaction atmosphere — Pressure (torr) | Reaction atmosphere — Temperature (° C.) |
|---|---|---|---|
| $Al_2O_3$ . | $Al_2Cl_3$: 4, $CO_2$: 10, $H_2S$: 0.2, HCl: 2, $H_2$: balance | 50 | 1020 |
| $Al_2O_3$ | $Al[OCH(CH_3)_2]_3$: 0.3, $H_2$: balance | 50 | 900 |
| TiC | $TiCl_4$: 2, $C_3H_8$: 5, $H_2$: balance | 100 | 900 |
| TiN | $TiCl_4$: 2, $N_2$: 30, $H_2$: balance | 100 | 850 |
| TiCN | $TiCl_4$: 2, $N_2$: 10, $CH_3CN$: 0.8, $H_2$: balance | 70 | 900 |
| TiCO | $TiCl_4$: 3, CO: 2, $H_2$: balance | 100 | 900 |
| TiNO | $TiCl_4$: 3, CO: 1, $N_2$: 15, $H_2$: balance | 50 | 900 |
| TiCNO | $TiCl_4$: 3, CO: 2, $N_2$: 15, $H_2$: balance | 50 | 900 |

[In Table 11, item with * shows high, temperature chemical vapor deposition (HT-CVD) and items without * show medium temperature chemical vapor deposition (MT-CVD).]

TABLE 12

| Type | Symbol of substrate | Hard-material-coated-layer (average layer thickness is shown in parentheses, unit: μm) First layer | Second layer | Third layer | Fourth layer | Fifth layer | Width of max-flank wear of cutting edge |
|---|---|---|---|---|---|---|---|
| coated carbide endmill of the present invention | | | | | | | |
| 1 | A | TiN(0.2) | TiCN(3.0) | TiCNO(0.1) | $Al_2O_3$(0.2) | — | 0.05 |
| 2 | B | TiCN(0.3) | TiCNO(1.4) | $Al_2O_3$(0.1)* | — | — | 0.06 |
| 3 | C | TiCN(2.0) | — | — | — | — | 0.18 |
| 4 | D | TiCN(1.6) | $Al_2O_3$(0.4)* | — | — | — | 0.07 |
| 5 | E | TiN(0.1) | TiC(2.0) | TiCN(2.0) | TiNO(0.1) | TiN(0.3) | 0.19 |
| 6 | F | TiN(1.0) | TiC(2.5) | $Al_2O_3$(0.5)* | — | — | 0.09 |
| 7 | G | TiN(0.5) | TiC(1.0) | TiCN(1.5) | TiN(0.5) | — | 0.18 |
| 8 | H | TiCN(0.9) | TiCNO(0.1) | $Al_2O_3$(0.3)* | TiCO(0.1) | TiN(0.1) | 0.11 |
| 9 | I | TiC(0.5) | TiCO(0.3) | $Al_2O_3$(0.2) | — | — | 0.12 |
| 10 | J | TiN(0.8) | TiCN(0.2) | — | — | — | 0.08 |
| 11 | K | TiCN(1.3) | TiNO(0.1) | $Al_2O_3$(0.4)* | TiN(0.2) | — | 0.09 |
| 12 | L | TiN(0.1) | TiC(0.5) | TiCN(0.9) | — | — | 0.15 |
| 13 | M | TiC(0.3) | TiCNO(0.1) | $Al_2O_3$(0.1) | — | — | 0.12 |
| 14 | N | TiN(0.6) | — | — | — | — | 0.19 |
| 15 | O | TiN(0.1) | TiCN(1.2) | TiCNO(0.1) | $Al_2O_3$(0.1) | — | 0.08 |
| 16 | P | TiN(0.1) | TiCN(2.1) | $Al_2O_3$(0.3)* | — | — | 0.07 |
| 17 | Q | TiC(1.0) | TiCN(0.9) | TiCNO(0.1) | $Al_2O_3$(1.0) | — | 0.11 |
| 18 | R | TiC(1.9) | TiCNO(0.5) | TiN(0.1) | — | — | 0.15 |
| 19 | S | TiN(0.1) | TiCN(1.4) | TiN(1.0) | — | — | 0.18 |
| 20 | T | TiC(0.1) | TiCN(4.4) | — | — | — | 0.19 |

[In Table 12, items with * show hard-material-coated-layers made by high temperature chemical vapor deposition and items without * show hard-material-coated-layers made by medium temperature chemical vapor deposition, respectively.]

TABLE 13

| Type | Symbol of substrate | Hard-material-coated-layer First layer | Second layer | Third layer | Fourth layer | Fifth layer | Width of max-flank wear of cutting edge |
|---|---|---|---|---|---|---|---|
| Comparative coated carbide endmill | | | | | | | |
| 1 | a | similar to coated carbide endmill 1 of the present invention | | | | | 0.32 |
| 2 | b | similar to coated carbide endmill 2 of the present invention | | | | | 0.34 |
| 3 | c | similar to coated carbide endmill 3 of the present invention | | | | | 0.43 |
| 4 | d | similar to coated carbide endmill 4 of the present invention | | | | | 0.3 |
| 5 | e | similar to coated carbide endmill 5 of the present invention | | | | | 0.42 |
| 6 | f | similar to coated carbide endmill 6 of the present invention | | | | | 0.35 |
| 7 | g | similar to coated carbide endmill 7 of the present invention | | | | | 0.41 |
| 8 | h | similar to coated carbide endmill 8 of the present invention | | | | | 0.35 |
| 9 | i | similar to coated carbide endmill 9 of the present invention | | | | | 0.38 |
| 10 | 1 | similar to coated carbide endmill 10 of the present invention | | | | | 0.31 |
| 11 | k | similar to coated carbide endmill 11 of the present invention | | | | | 0.33 |
| 12 | l | similar to coated carbide endmill 12 of the present invention | | | | | 0.40 |
| 13 | m | similar to coated carbide endmill 13 of the present invention | | | | | 0.37 |
| 14 | n | similar to coated carbide endmill 14 6f the present invention | | | | | 0.46 |
| 15 | o | similar to coated carbide endmill 15 of the present invention | | | | | 0.3 |
| 16 | p | similar to coated carbide endmill 16 of the present invention | | | | | 0.32 |
| 17 | q | similar to coated carbide endmill 17 of the present invention | | | | | 0.37 |
| 18 | r | similar to coated carbide endmill 18 of the present invention | | | | | 0.39 |
| 19 | s | similar to coated carbide endmill 19 of the present invention | | | | | 0.43 |
| 20 | t | similar to coated carbide endmill 20 of the present invention | | | | | 0.44 |

TABLE 14

| Type | | Composition (wt %) Co | Cr | V | (Ti, Ta, Nb, Zr) C · N | WC + impurities | Average grain size of WC (μm) |
|---|---|---|---|---|---|---|---|
| Cemented carbide substrate | a | 12.0 | 0.48 | 0.50 | TiC: 1.9 | balance | 0.9 |
| | b | 7.9 | 0.23 | 1.02 | TaN: 0.5 | balance | 1.2 |
| | c | 14.8 | 1.41 | — | TaCN:1.5 | balance | 0.4 |
| | d | 10.1 | 1.42 | 0.51 | NbN: 1.3 | balance | 0.5 |
| | e | 17.8 | — | 1.55 | NbCN: 3.3 | balance | 0.2 |
| | f | 5.3 | — | 0.10 | ZrCN: 0.9 | balance | 1.3 |
| | g | 9.8 | 0.52 | — | TaC: 1.0 | balance | 1.0 |
| | h | 12.1 | — | 0.16 | NbC: 3.0 | balance | 0.5 |
| | i | 7.8 | 0.39 | — | ZrN: 1.2 | balance | 1.5 |
| | j | 14.7 | — | 1.21 | TiCN: 4.1 | balance | 1.0 |
| | k | 5.0 | 0.20 | — | TiN: 0.5 | balance | 1.0 |
| | l | 15.2 | 1.23 | — | Zrc: 2.3 | balance | 0.3 |
| | m | 11.9 | 1.04 | — | (Ta, Nb) C: 1.5 | balance | 0.5 |
| | n | 10.2 | 0.79 | — | TaC: 0.5, ZrN: 0.5 | balance | 0.8 |
| | o | 5.3 | — | 0.17 | (Ti, Ta, Zr) C: 0.1 | balance | 1.5 |
| | p | 19.8 | 0.87 | 0.97 | (Ti, Ta, Nb, Zr) C: 5.0 | balance | 0.1 |
| | q | 8.1 | — | 0.39 | (Ti, Zr) C: 1.0, NbC: 0.1 | balance | 1.2 |
| | r | 16.9 | — | 1.98 | (Ta, Nb) C: 0.5, TaC: 1.0 | balance | 0.5 |
| | s | 9.8 | 0.89 | — | Tic: 0.2, TaN: 0.8 NbC: 0.2, ZrCN: 1.6 | balance | 0.5 |

TABLE 15

| Type | | Symbol of substrate | Surface layer formed by being heated at high temperature — Forming conditions — Atmosphere: Ratio of composition blended to $H_2$ (vol %) | Pressure (torr) | Temperature (° C.) | Holding time (min.) | Average thickness of reaction-created surface layer (μm) |
|---|---|---|---|---|---|---|---|
| Cemented carbide substrate | A | a | $CO_2$: 9 | 500 | 950 | 13 | 1.22 |
| | B | b | $TiCl_4$: 3 | 350 | 950 | 8 | 0.54 |
| | C | c | $CO_2$: 11 | 400 | 900 | 15 | 1.01 |
| | D | d | $TiCl_4$: 2 | 250 | 950 | 6 | 0.87 |
| | E | e | $CO_2$: 10 | 150 | 950 | 2 | 0.30 |
| | F | f | $TiCl_4$: 1 | 400 | 1000 | 8 | 1.13 |
| | G | g | $CO_2$: 11 | 350 | 900 | 5 | 0.42 |
| | H | h | $TiCl_4$: 2 | 350 | 950 | 10 | 1.04 |
| | I | i | $CO_2$: 10 | 400 | 1000 | 15 | 1.53 |
| | J | j | $TiCl_4$: 3 | 450 | 900 | 13 | 1.31 |
| | K | k | $TiCl_4$: 3 | 550 | 1000 | 15 | 1.94 |
| | L | l | $CO_2$: 9 | 500 | 950 | 10 | 0.87 |
| | M | m | $TiCl_4$: 2 | 350 | 950 | 6 | 0.45 |
| | N | n | $CO_2$: 10 | 400 | 920 | 8 | 0.51 |
| | O | o | $CO_2$: 11 | 200 | 900 | 4 | 0.34 |
| | P | p | $CO_2$: 9 | 50 | 900 | 2 | 0.11 |
| | Q | q | $TiCl_4$: 1 | 300 | 1000 | 3 | 0.80 |
| | R | r | $TiCl_4$: 1 | 150 | 950 | 7 | 0.23 |
| | S | s | $TiCl_4$: 2 | 100 | 900 | 5 | 0.17 |

TABLE 16

| Type of hard-material-coated-layer | Hard-material-coated-layer forming conditions — Composition of reaction gas (vol %) | Reaction atmosphere: Pressure (torr) | Temperature (° C.) |
|---|---|---|---|
| $Al_2O_3$* | $Al_2Cl_3$: 4, $CO_2$: 10, $H_2S$: 0.2, HCl: 2, $H_2$: balance | 50 | 1020 |
| $Al_2O_3$ | $Al[OCH(CH_3)_2]_3$: 0.3, $H_2$: balance | 50 | 900 |
| TiC | $TiCl_4$: 2, $C_3H_8$: 5, $H_2$: balance | 100 | 900 |
| TiN | $TiCl_4$: 2, $N_2$: 30, $H_2$: balance | 100 | 850 |
| TiCN | $TiCl_4$: 2, $N_2$: 10, $CH_3CN$: 0.8, $H_2$: balance | 70 | 900 |
| TiCO | $TiCl_4$: 3, CO: 2, $H_2$: balance | 100 | 900 |
| TiNO | $TiCl_4$: 3, CO: 1, $N_2$: 15, $H_2$: balance | 50 | 900 |
| TiCNO | $TiCl_4$: 3, CO: 2, $N_2$: 15, $H_2$: balance | 50 | 900 |

[In Table 16, item with * shows high, temperature chemical vapor deposition (HT-CVD) and items without * show medium temperature chemical vapor deposition (MT-CVD).]

TABLE 17

| Type | Symbol of substrate | Hard-material-coated-layer (average layer thickness is shown in parentheses, unit: μm) First layer | Second layer | Third layer | Fourth layer | Fifth layer | Width of max-flank wear of cutting edge |
|---|---|---|---|---|---|---|---|
| coated carbide endmill of the present invention | | | | | | | |
| 1 | A | TiN(0.1) | TiCN(0.5) | TIC(0.5) | $Al_2O_3$(0.1)* | TIN(0.1) | |
| 2 | B | TiCN(2.1) | $Al_2O_3$(0.3)* | TiN(0.2) | — | — | 0.08 |
| 3 | C | TiC(3.5) | TiCO(0.1) | $Al_2O_3$(0.3) | — | — | 0.09 |

TABLE 17-continued

| Type | Symbol of substrate | Hard-material-coated-layer (average layer thickness is shown in parentheses, unit: μm) First layer | Second layer | Third layer | Fourth layer | Fifth layer | Width of max-flank wear of cutting edge |
|---|---|---|---|---|---|---|---|
| 4 | D | TiN(0.2) | TiCN(2.0) | TiC(0.3) | $Al_2O_3$(0.2) | — | 0.07 |
| 5 | E | TiN(2.0) | — | — | — | — | 0.18 |
| 6 | F | TiCN(0.9) | $Al_2O_3$(0.1) | — | — | — | 0.07 |
| 7 | G | TiN(0.1) | TiCN(3.0) | TiC(0.9) | TiCNO(0.1) | $Al_2O_3$(0.4)* | 0.07 |
| 8 | H | TiC(3.0) | — | — | — | — | 0.17 |
| 9 | I | TiN(0.1) | TiCN(1.8) | TiN(0.1) | — | — | 0.16 |
| 10 | J | TiC(2.0) | TiN(1.0) | — | — | — | 0.15 |
| 11 | K | TiCN(0.5) | — | — | — | — | 0.19 |
| 12 | L | TIC(2.0) | $Al_2O_3$(0.5) | — | — | — | 0.12 |
| 13 | H | TiN(0.2) | TiCN(2.0) | TiNO(0.1) | $Al_2O_3$(0.5)* | TiN(0.2) | 0.07 |
| 14 | N | TiN(0.1) | TiCN(1.0) | TiCNO(0.1) | $Al_2O_3$(0.5)* | — | 0.06 |
| 15 | O | TiCN(1.5) | $Al_2O_3$(0.5) | — | — | — | 0.08 |
| 16 | P | TiCN(2.9) | TiCNO(0.2) | $Al_2O_3$(0.4) | — | — | 0.12 |
| 17 | Q | TiC(1.7) | TiCO(0.1) | $Al_2O_3$(0.2) | — | — | 0.09 |
| 18 | R | TiCN(1.5) | TiN(0.1) | TiCN(1.5) | TiC(0.5) | $Al_2O_3$(0.4)* | 0.07 |
| 19 | S | TiN(0.1) | TiCN(0.5) | TiC(0.2) | $Al_2O_3$(0.2) | — | 0.08 |

[In Table 17, item with * shows hard-material-coated-layers made by high temperature chemical vapor deposition and items without * show hard-material-coated-layers made by medium temperature chemical vapor deposition, respectively.]

TABLE 18

| Type | Symbol of substrate | Hard-material-coated-layer | Result of cutting test |
|---|---|---|---|
| Comparative coated carbide endmill | | | |
| 1 | a | similar to coated carbide endmill 1 of the present invention | life ended in 40 m |
| 2 | b | similar to coated carbide endmill 2 of the present invention | life ended in 40 m |
| 3 | c | similar to coated carbide endmill 3 of the present invention | life ended in 35 m |
| 4 | d | similar to coated carbide endmill 4 of the present invention | life ended in 45 m |
| 5 | e | similar to coated carbide endmill 5 of the present invention | life ended in 20 m |
| 6 | f | similar to coated carbide endmill 6 of the present invention | life ended in 45 m |
| 7 | g | similar to coated carbide endmill 7 of the present invention | life ended in 45 m |
| 8 | h | similar to coated carbide endmill 8 of the present invention | life ended in 20 m |
| 9 | i | similar to coated carbide endmill 9 of the present invention | life ended in 20 m |
| 10 | j | similar to coated carbide endmill 10 of the present invention | life ended in 25 m |
| 11 | k | similar to coated carbide endmill 11 of the present invention | life ended in 20 m |
| 12 | l | similar to coated carbide endmill 12 of the present invention | life ended in 30 m |
| 13 | m | similar to coated carbide endmill 13 of the present invention | life ended in 45 m |

TABLE 18-continued

| Type | Symbol of substrate | Hard-material-coated-layer | Result of cutting test |
|---|---|---|---|
| 14 | n | similar to coated carbide endmill 14 of the present invention | life ended in 45 m |
| 15 | o | similar to coated carbide endmill 15 of the present invention | life ended in 40 m |
| 16 | p | similar to coated carbide endmill 16 of the present invention | life ended in 30 m |
| 17 | q | similar to coated carbide endmill 17 of the present invention | life ended in 35 m |
| 18 | r | similar to coated carbide endmill 18 of the present invention | life ended in 45 m |
| 19 | s | similar to coated carbide endmill 19 of the present invention | life ended in 40 m |

(life is ended by exfoliation of hard-material-coated-layer in any case)

Obviously, numerous modifications and variations of the present invention are possible in light of the above teachings. It is therefore to be understood that within the scope of the appended claims, the invention may be practiced otherwise than as specifically described herein.

The priority document of the present application, Japanese Patent Application No. 9-236882 filed on Sep. 2, 1997, is hereby incorporated by reference.

What is claimed is:

1. A coated cemented carbide endmill, comprising:

(a) a substrate, comprising tungsten carbide grains having an average grain size of 0.1–1.5 μm, (b) a first layer having a thickness of 0.1–2 μm, on said substrate, in which a complex carbide of cobalt and tungsten is distributed, and (c) a coating having a thickness of 0.5–4.5 μm, on said first layer, wherein said coating comprises at least one layer, and said at least one layer is selected from the group consisting of layers of TiC, TiN, TiCN, TiCO, TiNO, TiCNO and $Al_2O_3$.

2. The coated cemented carbide endmill of claim 1, wherein said at least one layer is selected from the group consisting of layers of TiC, TiN, TiCN, TiCO, TiNO and TiCNO.

3. The coated cemented carbide endmill of claim 2, wherein said first layer is distributed on an uppermost surface of a cutting edge of said substrate.

4. The coated cemented carbide endmill of claim 1, wherein said first layer is distributed on an uppermost surface of a cutting edge of said substrate.

5. The coated cemented carbide endmill of claim 1, wherein said substrate further comprises 5–20 wt % Co.

6. The coated cemented carbide endmill of claim 5, wherein said substrate further comprises at least one member selected from the group consisting of 0.1–2 wt % Cr and 0.1–2 wt % V.

7. The coated cemented carbide endmill of claim 6, wherein said substrate further comprises 0.1–5 wt % of at least one member selected from the group consisting of carbides and nitrides of Ti, Ta, Nb and Zr, and solid solutions thereof.

8. The coated cemented carbide endmill of claim 5, wherein said substrate further comprises 0.1–5 wt % of at least one member selected from the group consisting of carbides and nitrides of Ti, Ta, Nb and Zr, and solid solutions thereof.

9. The coated cemented carbide endmill of claim 1, wherein said first layer has a thickness of 0.5–1.5 $\mu$m.

10. The coated cemented carbide endmill of claim 1, wherein said at least one layer comprises $Al_2O_3$.

11. A coated cemented carbide endmill, comprising:

(a) a substrate, comprising tungsten carbide grains having an average grain size of 0.1–1.5 $\mu$m, (b) a first layer having a thickness of 0.1–2 $\mu$m, on said substrate, in which a complex carbide of cobalt and tungsten is distributed, and (c) a coating having a thickness of 0.5–4.5 $\mu$m, on said first layer, wherein said coating comprises at least one layer, and said at least one layer is selected from the group consisting of layers of TiC, TiN, TiCN, TiCO, TiNO, TiCNO and $Al_2O_3$, and wherein said coating (c) is formed by medium chemical vapor deposition at a temperature of 700–980° C.

12. The coated cemented carbide endmill of claim 11, wherein said at least one layer is selected from the group consisting of layers of TiC, TiN, TiCN, TiCO, TiNO and TICNO.

13. The coated cemented carbide endmill of claim 12, wherein said first layer is distributed on an uppermost surface of a cutting edge of said substrate.

14. The coated cemented carbide endmill of claim 11, wherein said at least one layer comprises $Al_2O_3$.

15. The coated cemented carbide endmill of claim 11, wherein said first layer is distributed on an uppermost surface of a cutting edge of said substrate.

16. The coated cemented carbide endmill of claim 11, wherein said substrate further comprises 5–20 wt % Co.

17. The coated cemented carbide endmill of claim 16, wherein said substrate further comprises at least one member selected from the group consisting of 0.1–2 wt % Cr and 0.1–2 wt % V.

18. The coated cemented carbide endmill of claim 17, wherein said substrate further comprises 0.1–5 wt % of at least one member selected from the group consisting of carbides and nitrides of Ti, Ta, Nb and Zr, and solid solutions thereof.

19. The coated cemented carbide endmill of claim 16, wherein said substrate further comprises 0.1–5 wt % of at least one member selected from the group consisting of carbides and nitrides of Ti, Ta, Nb and Zr, and solid solutions thereof.

20. A method of making a coated cemented carbide endmill of claim 1, comprising:

forming a first layer having a thickness of 0.1–2 $\mu$m, in which a complex carbide of cobalt and tungsten is distributed, on a substrate; and forming a coating having a thickness of 0.5–4.5 $\mu$m, on said first layer;

wherein said substrate comprises tungsten carbide grains having an average grain size of 0.1–1.5 $\mu$m, said coating comprises at least one layer, and said at least one layer is selected from the group consisting of layers of TiC, TiN, TiCN, TiCO, TiNO, TiCNO and $Al_2O_3$.

21. The method of claim 20, wherein said substrate further comprises 5–20 wt % Co.

22. The method of claim 21, wherein said substrate further comprises at least one member selected from the group consisting of 0.1–2 wt % Cr and 0.1–2 wt % V.

23. The method of claim 22, wherein said substrate further comprises 0.1–5 wt % of at least one member selected from the group consisting of carbides and nitrides of Ti, Ta, Nb and Zr, and solid solutions thereof.

24. The method of claim 21, wherein said substrate further comprises 0.1–5 wt % of at least one member selected from the group consisting of carbides and nitrides of Ti, Ta, Nb and Zr, and solid solutions thereof.

25. The method of claim 20, wherein said first layer is formed by heating said substrate in an atmosphere comprising hydrogen and at least one member selected from the group consisting of carbon dioxide and titanium tetrachloride.

26. The method of claim 25, wherein said atmosphere is at a pressure of 50–500 torr.

27. The method of claim 25, wherein said heating is a temperature of 900–1000° C.

28. The method of claim 27, wherein said coating is formed by medium temperature chemical vapor deposition at a temperature of 700–980° C.

29. The product produced by the method of claim 28.

30. The coated cemented carbide endmill prepared by the method of claim 16.

31. The product produced by the method of claim 25.

32. The method of claim 20, wherein said coating is formed by medium temperature chemical vapor deposition at a temperature of 700–980° C.

33. The method of claim 20, wherein said at least one layer comprises $Al_2O_3$.

* * * * *